US007402555B2

(12) United States Patent
Moore et al.

(10) Patent No.: US 7,402,555 B2
(45) Date of Patent: Jul. 22, 2008

(54) COMPOSITIONS USEFUL AS FABRIC SOFTENERS

(75) Inventors: John W Moore, Wilmington, DE (US); Christopher S Moore, Wilmington, DE (US); Cassie M Lilienthal, Philadelphia, PA (US); Ashwinkumar Jaju, Wilmington, DE (US)

(73) Assignee: Optimer, Inc., Wilmington, DE (US)

( * ) Notice: Subject to any disclaimer, the term of this patent is extended or adjusted under 35 U.S.C. 154(b) by 43 days.

(21) Appl. No.: 10/589,839

(22) PCT Filed: Feb. 17, 2005

(86) PCT No.: PCT/US2005/004979

§ 371 (c)(1),
(2), (4) Date: Aug. 17, 2006

(87) PCT Pub. No.: WO2005/079439

PCT Pub. Date: Sep. 1, 2005

(65) Prior Publication Data

US 2007/0093408 A1 Apr. 26, 2007

Related U.S. Application Data

(60) Provisional application No. 60/549,383, filed on Mar. 2, 2004, provisional application No. 60/545,045, filed on Feb. 17, 2004.

(51) Int. Cl.
*C11D 1/835* (2006.01)

(52) U.S. Cl. ..... 510/466; 510/501; 510/504; 510/522; 510/527

(58) Field of Classification Search ..... 510/418, 510/466, 475, 501, 522, 504, 527
See application file for complete search history.

(56) References Cited

U.S. PATENT DOCUMENTS

| | | | | |
|---|---|---|---|---|
| 4,335,238 | A | 6/1982 | Moore et al. | 526/254 |
| 4,446,035 | A | 5/1984 | Barrat et al. | 510/335 |
| 4,986,922 | A | 1/1991 | Snow et al. | 510/329 |
| 5,830,843 | A | 11/1998 | Hartman et al. | 510/475 |
| 6,358,913 | B1 | 3/2002 | Schaumann et al. | 510/515 |
| 6,734,153 | B2 * | 5/2004 | Scheper | 510/285 |
| 6,855,173 | B2 | 2/2005 | Ehrnsperger et al. | 8/142 |
| 6,881,715 | B2 | 4/2005 | Katz | 510/437 |
| 6,894,014 | B2 | 5/2005 | Deak et al. | 510/285 |
| 7,018,973 | B2 | 3/2006 | Katz | 510/466 |
| 7,141,077 | B2 * | 11/2006 | Detering et al. | 8/137 |
| 2004/0241130 | A1 * | 12/2004 | Tamareselvy et al. | 424/70.16 |
| 2005/0015888 | A1 * | 1/2005 | Altmann et al. | 8/115.51 |

FOREIGN PATENT DOCUMENTS

| | | | |
|---|---|---|---|
| WO | 00/71807 A1 | | 11/2000 |
| WO | WO 01/60961 | * | 8/2001 |
| WO | 2004/044115 A1 | | 5/2004 |

OTHER PUBLICATIONS

Egan, R. R., "Cationic Surface Active Agents as Fabric Softeners," *J. Am. Oil Chemists Soc.*, Jan. 1978, 55, 118-121.
Evans, W. P., "Cationic fabric softeners," *Chemistry and Industry*, Jul. 5, 1969, 893-903.
*Kirk Othmer's Encyclopedia of Chemical Technology*, 1992, 4th Edition, 271-300.

* cited by examiner

*Primary Examiner*—John R Hardee
(74) *Attorney, Agent, or Firm*—Woodcock Washburn LLP

(57) ABSTRACT

Compositions and methods of treating textiles are disclosed. More specifically, stable compositions and methods for softening a wide range of fabrics are disclosed, including 100% cotton and hydrophobic synthetic fabrics, without detrimentally affecting the water absorbency properties of the fabrics. The compositions and methods provide desirable odor control without interfering with the stability of the product. The compositions contain at least one fatty material, water-dispersible polyolefin or at least one water-soluble or waterdispersible polyorganosiloxane, and at least one bleaching agent, preferably hydrogen peroxide. The compositions may optionally contain discrete, individual polymer particles, preferably polytetrafluoroethylene (PTFE), polyvinyl acetate (PVA), polyvinyl acetate/acrylic copolymer (PVA/a), or a combination thereof. The compositions are particularly useful when added to the rinse water in the laundering process, or in the final scouring of a fabric finishing operation.

24 Claims, No Drawings

COMPOSITIONS USEFUL AS FABRIC SOFTENERS

CROSS-REFERENCE TO RELATED APPLICATIONS

This application is the National Stage of International Application No. PCT/US2005/004979, filed Feb. 17, 2005, which claims the benefit of the filing date of U.S. Provisional Application No. 60/545,045, filed Feb. 17, 2004, and U.S. Provisional Patent Application No. 60/549,383, filed Mar. 2, 2004. The entire contents of these patent applications are hereby incorporated by reference.

FIELD OF THE INVENTION

The present invention generally relates to compositions and methods of treating, textiles and, more specifically, to compositions and methods of treating textiles with compositions containing a fatty material, a polyolefin or polyorganosiloxane, a bleaching agent, and optional discrete, individual polymer particles, which may be added to rinse water in a laundering process, or in a final scouring of a fabric finishing operation.

BACKGROUND OF THE INVENTION

Fabric softeners are widely used by home consumers and commercial laundries to provide softness, surface smoothness, good draping qualities, fluffiness and antistatic properties while avoiding surface greasiness or excessive build-up on the fabric. Although fabric softener technology is well known, the exact softening mechanism is not known. One commonly accepted mechanism relates softness to the lubricity of the adsorbed softener on the cloth and the consequent reduction of friction between the fabric fibers.

Fabric softener compositions that can be added to the rinse water when washing household laundry normally contain, as active substance, a water-insoluble quaternary ammonium compound. Commercially available fabric softener compositions are based on aqueous dispersions of water-insoluble quaternary compounds. Recently, there has been increasing interest in biodegradable active substances. Such substances include, for example, esters of quaternary ammonium compounds, so-called "esterquats," which have at least one long-chain hydrophobic alkyl or alkenyl group interrupted by carboxyl groups.

Active substances in fabric softener compositions that impart a good soft handle to the treated textile generally have the disadvantage that they may lower the water absorbency and wickability of the textile fabric. This is troublesome in the use of 100% cotton items, such as towels and diapers, where softness and water absorbency properties are both desired. The problem is generally exacerbated in more hydrophobic synthetic fibers, such as polyester, polypropylene, and nylon and blends thereof with other synthetic and natural fibers. The problem may be so severe that many garments made from high performance fabrics where the ability to rapidly wick water from the skin and dry quickly actually include warnings against using any fabric softener during the laundering process because the use of the fabric softener may destroy the water-absorbency, rewettability and wickability properties of the fabric—properties key to their performance. The disadvantage of reduced water absorbency is often highly pronounced in the case of certain active substances, such as the fatty acid quats.

Others have addressed this trade-off in softness and water-absorbency properties. For example, U.S. Pat. No. 6,358,913 discloses a fabric softener composition containing:

(a) as an active substance, a quaternary ammonium compound of the formula:

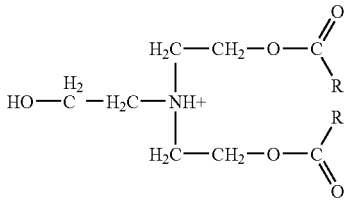

where R is the aliphatic radical of tallow fatty acid, in particular a mono- or polyunsaturated aliphatic $C_{17}$ radical; and (b) a nitrogen-free polydiorganosiloxane having terminal silicon-bonded hydroxyl groups. As another example, U.S. Pat. No. 5,830,843 discloses a liquid fabric softener composition comprising:

(a) about 0.05% to about 50% by weight of the composition of a cationic quaternary ammonium fabric softening compound or amine precursor;

(b) about 0.01% to about 50% by weight of the composition of a dispersible polyolefin;

(c) optionally, about 0% to about 30% by weight of the composition of a dispersibility modifier; and (d) the balance comprising a liquid carrier selected from the group consisting of: water; $C_{1-4}$monohydric alcohol; $C_{2-6}$polyhydric alcohol; propylene carbonate; liquid polyethylene glycols; and mixtures thereof;

wherein the level of amphoteric surfactant, if any, is less than about 1% by weight of said composition.

Rinse cycle fabric softener compositions desirably contain a bleaching system to further clean and remove unwanted odors remaining in the fabric after washing. This bleaching system is often an oxidizer, such as a hydrogen peroxide source. As such, the bleaching system may interfere with the stability of the rinse cycle fabric softener composition.

Accordingly, there is a need for additional fabric softener compositions that improve the water-absorbency, rewettability and wickability properties of the treated textiles without impairing the other desirable properties of the treated textiles provided by use of the compositions, such as softness and static properties, while providing desirable odor control without interfering with the stability of the product. The present invention is directed to this, as well as other important ends.

SUMMARY OF THE INVENTION

The present invention is generally directed to compositions and methods of softening and providing odor control for a wide range of fabric types, preferably without detrimentally decreasing water absorbency properties of the fabrics.

In one embodiment, the invention is directed to compositions, comprising:

a. at least one fatty material;

b. at least one polymer selected from the group consisting of water-dispersible polyolefin; water-soluble polyorganosiloxane having substituents, and water-dispersible polyorganosiloxane having substituents;

c. at least one bleaching agent;

wherein said fatty material is:

i. a fatty acid quaternary ammonium compound having ester functionality;

ii. a fatty acid quaternary ammonium compound having amide functionality;

iii. a fatty acid alkoxylated quaternary ammonium compound;

iv. a nonionic fatty acid ester;

v. a fatty acid condensation product;

vi. an alkylmethyl quaternary ammonium compound;

vii. an amido alkoxylated quaternary ammonium compound;

viii. quaternized amido imidazoline;

ix. polyamine salt;

x. polyalkylene imine salt; or xi. alkyl pyridinium salt; and wherein said polyorganosiloxane is present at a level of at least about 35% by weight, based on the total weight of said fatty material, said polyorganosiloxane, said polyolefin, and said bleaching agent; and wherein said substituents comprise at least about 5% by weight, based on the total weight of said substituents, of non-terminal hydroxyl groups.

In other embodiments, the invention is directed to compositions further comprising discrete, individual polymer particles. Preferably, the polymer particles are polytetrafluoroethylene (PTFE), polyvinyl acetate (PVA), polyvinyl acetate/acrylic copolymer (PVA/a), or a combination thereof.

In certain embodiments of the invention, the aforementioned compositions may additionally comprise a detergent. In some embodiments, the detergent is an oxylated detergent.

In yet other embodiments, the invention is directed to methods of treating a textile, comprising the step of:

contacting said textile with a composition, comprising:

a. at least one fatty material;

b. at least one polymer selected from the group consisting of water-dispersible polyolefin and water-soluble polyorganosiloxane having substituents, or water-dispersible polyorganosiloxane having substituents;

c. at least one bleaching agent;

d. optionally, discrete, individual polymer particles;

wherein said fatty material is:

i. a fatty acid quaternary ammonium compound having ester functionality;

ii. a fatty acid quaternary ammonium compound having amide functionality;

iii. a fatty acid alkoxylated quaternary ammonium compound;

iv. a nonionic fatty acid ester;

v. a fatty acid condensation product;

vi. an alkylmethyl quaternary ammonium compound;

vii. an amido alkoxylated quaternary ammonium compound;

viii. quaternized amido imidazoline;

ix. polyamine salt;

x. polyalkylene imine salt; or xi. alkyl pyridinium salt; and wherein said polyorganosiloxane is present at a level of at least about 35% by weight, based on the total weight of said fatty material, said polyorganosiloxane, said polyolefin, and said bleaching agent; and wherein said substituents comprise at least about 5% by weight, based on the total weight of said substituents, of non-terminal hydroxyl groups.

DETAILED DESCRIPTION OF THE INVENTION

The invention concerns compositions that are useful, for example, as rinse cycle fabric softeners. In addition, the instant compositions provide odor control advantages. In some embodiments, the compositions may further comprise discrete, individual polymer particles that reduce spin-dry times, reduce spin-dry water contents, and increase water release rates. In some embodiments, the compositions may further comprise detergent.

In some embodiments, the invention relates to compositions and methods for conditioning fabrics during the rinse cycle of laundering operations. This is a widely used practice to impart to laundered fabrics a texture or handle that is smooth, pliable and fluffy to the touch (i.e. soft) and also to impart to the fabrics a reduced tendency to pick up and/or retain an electrostatic charge (i.e. static control), especially when the fabrics are dried in an automatic dryer. In addition, the compositions and methods of the invention enable improved softening and static control without detrimentally affecting the wickability of the fabrics.

In one embodiment, the invention is directed to compositions, comprising:

a. at least one fatty material;

b. at least one polymer selected from the group consisting of water-dispersible polyolefin, water-soluble polyorganosiloxane having substituents, and water-dispersible polyorganosiloxane having substituents;

c. at least one bleaching agent;

wherein said fatty material is:

i. a fatty acid quaternary ammonium compound having ester functionality;

ii. a fatty acid quaternary ammonium compound having amide functionality;

iii. a fatty acid alkoxylated quaternary ammonium compound;

iv. a nonionic fatty acid ester;

v. a fatty acid condensation product;

vi. an alkylmethyl quaternary ammonium compound;

vii. an amido alkoxylated quaternary ammonium compound;

viii. quaternized amido imidazoline;

ix. polyamine salt;

x. polyalkylene imine salt; or xi. alkyl pyridinium salt; and wherein said polyorganosiloxane is present at a level of at least about 35% by weight, based on the total weight of said fatty material, said polyolefin or polyorganosiloxane, and said bleaching agent; and wherein said substituents comprise at least about 5% by weight, based on the total weight of said substituents, of non-terminal hydroxyl groups.

In certain embodiments, the polymer is a water-soluble polyorganosiloxane having substituents, or water-dispersible polyorganosiloxane having substituents.

In certain embodiments, the bleaching agent is hydrogen peroxide, inorganic peroxohydrate, organic peroxohydrate, or organic peroxyacid or combination thereof.

In other embodiments, the composition further comprises an optional wetting agent.

In certain preferred embodiments, the invention is directed to an aqueous composition. The compositions of the invention may be formulated with other optional components, including perfumes, colorants, preservatives, and stabilizers.

Such formulations may be in the form of aqueous suspensions or emulsions that may be conveniently added to the rinse water in the laundering process, or in a final scouring of a fabric finishing operation.

In certain preferred embodiments, the polyorganosiloxane does not contain nitrogen. Preferably, the polyorganosiloxane has a melting point less than about 38° C., preferably less than about 35° C., more preferably less than about 30° C. and even more preferably less than about 25° C. Preferably, the polyorganosiloxane is liquid at room temperature to ensure ease of handling. The melting point may be measured by differential scanning calorimetry at a rate of about 20° C./minute or in a capillary melting tube.

In another embodiment, the invention is directed to methods of treating a textile, comprising the step of contacting said textile with the composition described above. The compositions and methods of the invention may be used to treat a wide range of textile materials, from hydrophobic materials to hydrophilic materials to blends thereof. Preferably, the composition is added to the rinse water in the laundering process, or in a final scouring of a fabric finishing operation.

The fatty material component useful in the compositions and methods of the invention may be cationic or nonionic substances that are substantive on textile fabrics and which are capable of imparting softness and/or lubricity to textile fabrics. The fatty material component is present at a level of less than about 65% by weight, preferably less than about 60%, based on the total weight of active ingredients of fatty material, polyolefin or polyorganosiloxane, and bleaching agent.

Suitable fatty materials include, for example:

i. fatty acid quaternary ammonium compounds having ester functionality;
ii. fatty acid quaternary ammonium compounds having amide functionality;
iii. fatty acid alkoxylated quaternary ammonium compounds;
iv. nonionic fatty acid esters;
v. fatty acid condensation products;
vi. alkylmethyl quaternary ammonium compounds;
vii. amido alkoxylated quaternary ammonium compounds;
viii. quaternized amido imidazoline;
ix. polyamine salt;
x. polyalkylene imine salt; and
xi. alkyl pyridinium salts.

The fatty materials may be used individually or as admixtures with each other. For those fatty materials that are cationic, the counter ions preferably may be methyl sulfate or any halide.

Particularly preferred fatty materials include:

i. a fatty acid quaternary ammonium compound having amide functionality;
ii. a fatty acid alkoxylated quaternary ammonium compound; and
iii. a nonionic fatty acid ester.

Suitable fatty acid quaternary ammonium compound having ester functionality include, for example, ditallowdimethyl ammonium chloride, ditallowdimethyl ammonium methyl sulfate, and the like.

Suitable fatty acid quaternary ammonium compound having amide functionality include, for example, methyl bis (tallow amidoethyl) 2-hydroxyethyl ammonium methylsulfate and the like.

Suitable fatty acid alkoxylated quaternary ammonium compounds include, for example, tallowdimethyl(3-tallowalkoxypropyl)ammonium chloride and the like.

Suitable nonionic fatty acid esters include glycerol monooleate, for example.

Suitable alkylmethyl quaternary ammonium compounds include, for example, those having either one alkyl chain containing about 18 to about 24 carbon atoms or two alkyl chains containing about 12 to about 30 carbon atoms, the long chain alkyl groups being most commonly those derived from hydrogenated tallow. Examples of such compounds are, tallowtrimethyl ammonium chloride, dieicosyldimethyl ammonium chloride, ditetradecyldimethyl ammonium chloride, didodecyldiethyl ammonium acetate, and tallowtrimethyl ammonium acetate.

Suitable amido alkoxylated quaternary ammonium compounds, for example, may be prepared from fatty acids or triglycerides and an amine, for example, diethylene triamine. The product is then alkoxylated, for example, with ethylene oxide or propylene oxide and quaternized with an alkylating agent, for example, a methylating agent, such as dimethyl sulfate. Compounds may be represented by the formula:

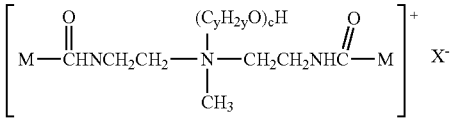

wherein M represents a fatty alkyl group typically about 12 to about 20 carbon atoms; X represents a halogen, such as Cl or Br, or a residue of the alkylating agent, for example, a methyl sulfate group; y is 2 or 3; and c is an integer.

Suitable quaternized amido imidazolines may be obtained, for example, by heating the alkoxylated product of the reaction product of an amine and a fatty acid or triglyceride as described for amido alkoxylated quaternary ammonium compounds to effect ring closure to the imidazoline. This is then quaternized by reaction with an alkylating agent, for example, dimethyl sulfate. An example of a quaternized amido imidazoline compound is 2-heptadecyl-1-methyl-1-(2'-stearoyl amidoethyl)-imidazolinium methyl sulfate.

Suitable polyamine salts and polyalkylene imine salts include, for example, $C_{12}H_{25}NH(CH_3)—(CH_2)_3—NH_2C_{12}H_{25}]^{+2}Cl_2^{-1}$;

$C_{18}H_{37}NH(CH_3)—(CH_2)_2—NH(C_2H_5)_2^{+2}]CH_3SO_4)^-{}_2$; and a polyethylene iminium chloride having about 10 ethylene imine units.

An example of a suitable alkyl pyridinium salt is cetyl pyridinium chloride.

The fatty materials that may be employed in the compositions and methods of the invention are well-known substances and have been widely described in the technical literature, see for example, *J. Am. Oil Chemists Soc.*, January 1978 (Volume 55), pages 118-121 and *Chemistry and Industry*, Jul. 5, 1969, pages 893-903, the disclosures of which are hereby incorporated herein by reference in their entirety.

The hydrophilic, water-soluble or water-dispersible polyorganosiloxanes having substituents that may be useful in the compositions and methods of the invention include linear or substantially linear siloxane polymers having at least about 5% by weight, based on the total weight of said substituents, of non-terminal hydroxyl groups. The average number of non-terminal hydroxyl groups per silicon atom may be determined using $^{29}$Si-NMR spectroscopy. The non-terminal hydroxyl groups may be bonded directly to the silicon atom. Alternatively, the non-terminal hydroxyl group may be bonded to a pendant group attached to the silicon atom.

As used herein, the term "water-soluble polyorganosiloxane" means a polyorganosiloxane having a water solubility at about 20° C. to about 50° C. of at least about 200 millimoles/liter in water. Such water-soluble polyorganosiloxanes form clear solutions upon addition to water, as observed visually by the naked eye. As used herein, the term "water-dispersible polyorganosiloxane" means a polyorganosiloxane having a water solubility at about 20° C. to about 50° C. of less than about 200 millimoles/liter in water. Such water-soluble polyorganosiloxanes form slightly turbid or slightly cloudy solutions upon addition to water, as observed visually by the naked eye.

Some polyorganosiloxanes useful in the compositions and methods of the invention are commercially available from Bayer Corporation under the tradename REACTOSIL® RWS and from Crompton Corporation under the tradename MAGNASOFT™ HWS.

In some preferred embodiments, the polyorganosiloxanes useful in the compositions and methods of the invention may have a weight-average molecular weight of at least about 750, as measured by size exclusion chromatography. The polyorganosiloxanes preferably have a molecular weight ranging from about 1,000 to about 25,000 and all combinations and subcombinations of molecular weight ranges and specific molecular weights therein.

Preferably, the polyorganosiloxanes contains at least about 50% by weight, based on the total weight of substituents in the polyorganosiloxane, of methyl radicals. The balance of other non-hydroxyl organic substituents present may be monovalent hydrocarbons having from about 2 to about 30 carbon atoms and all combinations and subcombinations of ranges and specific number of carbon atoms therein. Examples of suitable monovalent hydrocarbon radicals having from about 2 to about 30 carbon atoms include alkyl or cycloalkyl radicals, such as ethyl, propyl, butyl, n-octyl, tetradecyl, octadecyl, or cyclohexyl, alkenyl radicals, such as vinyl or allyl, and aryl or aralkyl radicals, such as phenyl or tolyl.

The polyorganosiloxane component is present at a level of at least about 35% by weight, preferably at least about 40%, based on the total weight of active ingredients of fatty material, polyolefin or polyorganosiloxane, and bleaching agent.

Suitable water-dispersible polyolefins useful in the compositions and methods of the invention include polyethylene, polypropylene, and mixtures thereof. The polyolefin may be at least partially modified to contain various functional groups, such as carboxyl, alkylamide, sulfonic acid, or amide groups. More preferably, the polyolefin employed in the present invention is at least partially carboxyl modified or, in other words, oxidized. In particular, oxidized or carboxyl modified polyethylene is preferred in the compositions and methods of the present invention.

The polyolefin component, if present, is present at a level of at least about 5% to about 50% by weight, preferably at least about 10% to about 40%, more preferably at least about 15% to about 35%, based on the total weight of active ingredients of fatty material, polyolefin or polyorganosiloxane, and bleaching agent.

For ease of formulation, the water-dispersible polyolefin is preferably introduced as a suspension or an emulsion of polyolefin dispersed by use of an emulsifying agent. The polyolefin suspension or emulsion preferably has from about 1% to about 50% by weight, more preferably from about 10% to about 35% by weight, and most preferably from about 15% to about 30% by weight of polyolefin in the emulsion. The polyolefin preferably has a molecular weight of from about 1,000 to about 15,000 and, more preferably, from about 4,000 to about 10,000.

When an emulsion is employed, the emulsifier may be any suitable emulsification agent. Preferably, the emulsifier is a cationic or nonionic surfactant or mixtures thereof. Most any suitable cationic or nonionic surfactant may be employed as the emulsifier of the present invention. Preferred emulsifiers of the present invention are cationic surfactants such as the fatty amine surfactants and in particular the ethoxylated fatty amine surfactants. In particular, the cationic surfactants are preferred as emulsifiers in the present invention when the pH of the liquid fabric softener composition is formulated in the preferred range of from about 2 to about 7. The water-dispersible polyolefin is dispersed by use of an emulsifier or suspending agent in a ratio of emulsifier to polyolefin of from about 1:10 to about 3:1. Preferably, the emulsion includes from about 0.1% to about 50%, more preferably from about 1% to about 20% and most preferably from about 2.5% to about 10% by weight of emulsifier in the polyolefin emulsion. Polyethylene emulsions suitable for use in the present invention are available under the tradename POMOLUBE from Piedmont Chemical Industries, Inc. in High Point, N.C. and VELUSTROL from Hoechst Aktiengesellschaft of Frankfurt am Main, Germany. In particular, the polyethylene emulsions sold under the trade names POMOLUBE 72R, VELUSTROL PKS, VELUSTROL KPA, and VELUSTROL P-40 may be employed in the compositions of the present invention.

The total weight of active ingredients of fatty materials, polyolefin or polyorganosiloxanes, and bleaching agent is not critical and depends upon individual practical and commercial considerations. For example, the compositions should be sufficiently fluid as to be readily dispersible during the scouring or laundering operation. In addition, they should preferably not be so dilute as to involve the cost of storing or transporting large volumes of water. With regard to cost considerations, the preferred aqueous compositions are those wherein the active ingredients of fatty materials polyolefin or polyorganosiloxanes, and bleaching agent are present at a level of about 5% to about 35% by weight and all combinations and subcombinations of weight % ranges and specific weight % therein, based on the total weight of the aqueous composition.

At least one bleaching agent is found in the instant compositions. Suitable bleaching agents include hydrogen peroxide, inorganic peroxohydrates, organic peroxohydrates, and organic peroxyacids, such as hydrophilic and hydrophobic mono- or di-peroxyacids. Suitable peroxyacids include peroxycarboxylic acids, peroxyimidic acids, amidoperoxycarboxylic acids, and their salts (such as calcium, magnesium, or mixed-cation salts). In certain preferred embodiments, the bleaching agent is hydrogen peroxide. Hydrogen peroxide sources are described in detail in *Kirk Othmer's Encyclopedia of Chemical Technology*, 4th Edition (New York: John Wiley & Sons), volume 4, pages 271-300 (1992), the disclosure of which is incorporated herein by reference.

Wetting agents are also used in certain embodiments of the instant invention. In general, wetting agents enhance the spread of the liquid on the fabric surface and enhance the penetration of the liquid into fabric. In some embodiments, these agents are substances that lower the surface tension to less than about 25 dynes/cm. These agents are well known to those skilled in the art. One useful wetting agent is DOW CORNING® Q2-5211 Super Wetting Agent, a silicone glycol copolymer, marketed by Dow Corning, which serves as a hydrophilic treatment.

In certain embodiments, the compositions further comprise discrete, individual polymer particles. In some preferred embodiments, the polymer particles are polytetrafluoroethylene (PTFE), polyvinyl acetate (PVA), polyvinyl acetate/acrylic copolymer (PVA/a), or a combination thereof. Preferably, the polymer particles are polytetrafluoroethylene. Textiles treated with the hydrophobic dispersions of polymer particles exhibit superior drying rates and lower spin-dry water contents and reduced pilling. Most surprisingly, the treated textiles exhibit superior drying properties at very low levels of treatment. By keeping the treatment levels low, the costs of treating the textiles and any negative effects are kept to a minimum.

In some embodiments, the preferred polymer particles are a dispersion of polytetrafluoroethylene (PTFE). PTFE dispersions used in the present invention may be applied in amounts ranging from about 0.1% to about 8% by weight of the textile material.

In certain embodiments, the PTFE, PVA, and PVA/a dispersions are applied in amounts ranging from about 0.1% to about 4% by weight of the textile material. In further embodiments, the PTFE, PVA, and PVA/a dispersions are applied in amounts ranging from about 0.1% to about 2% by weight of the textile material. Other embodiments have PTFE, PVA, and PVA/a dispersions applied in amounts ranging from about 0.1% to about 1% by weight of the textile material.

The dispersions of polymer particles are generally aqueous dispersions that may include additives, such as wetting agents, pigments, and stabilizers. The quantity of polymer particles in the dispersion can range from about 0.1% to about 60% by weight of the dispersion.

The surface energy of the dispersion particles can vary from one embodiment to another, however, the surface energy of the dispersion particles for any particular embodiment is greater than the surface energy of the textile being treated, whether the textile is hydrophilic or hydrophobic (i.e., the particles are more hydrophobic than the surface to which they are being applied). In certain embodiments, the surface energy of the dispersion particles ranges from about 28 to about 75 dynes/cm$^2$.

The discrete, individual particles useful in the textile materials, fabrics, and methods of the invention are more hydrophobic in nature than the surface to which they are to be applied to improve its water release characteristics. Preferably, the particles contain at least one polymeric material. However, the particles may include inorganic and organic non-polymeric additives, provided that their inclusion does not render the final particles less hydrophobic than the surface to which they are to be applied. Suitable inorganic additives include, for example, pigments, such as calcium carbonate or titanium dioxide, and colorants.

The polymeric particles may be solid or contain voids. The polymers may be single staged or multi-staged, such as for example, a core/shell polymer. The polymers useful in the invention may be linear or branched and, if copolymers, may be random or block copolymers. The polymeric particles may be blends of one or more different polymers. The polymers may formed by any conventional polymerization techniques, including condensation and free-radical polymerization techniques, such as emulsion and suspension polymerization. Conventional free-radical polymerization techniques are described, for example in Lovell and El Asser, *Emulsion Polymerization and Emulsion Polymers*, John Wiley and Sons, 1997, U.S. Pat. No. 4,335,238 and Canadian Patent No. 2,147,045. Preferably, the particles are formed in an aqueous free radical polymerization to form an aqueous dispersion of latex polymer particles.

The polymeric particles useful in the invention may have a particles size of about 100 nm to about 1 μm. The particle size and void fraction of the polymeric particles may be determined by conventional techniques known, including microscopy and the Brookhaven Model BI-90 Particle Sizer supplied by Brookhaven Instruments Corporation, Holtsville, N.Y., which employs a quasi-elastic light scattering technique to measure the size of the particles.

The molecular weights of the polymers useful in the invention are typically from about 100,000 to 5 million weight average and most commonly above 500,000.

Preferably, the polymeric particles useful in the invention have a glass transition temperature, as measured by differential scanning calorimetry at a rate of 20° C. per minute of at least 20° C. and, more preferably, of at least 50° C. A higher glass transition temperature contributes to a harder particle that is less likely to deform when applied to the surface and under the conditions of use, such as repeated washing and drying at elevated temperatures.

In certain preferred embodiments, the composition comprises:

- about 5% to about 50% by weight, preferably about 8% to about 30%, of the fatty material;
- at least about 35% by weight, preferably at least about 40%, of the water-dispersible polyorganosiloxane;
- about 10% to about 35% by weight, preferably about 20% to about 30%, of the bleaching agent;
- about 40 to about 80%, preferably about 45 to about 55%, of water;
- about 0% to about 10%, preferably about 4 to about 7%, of a wetting agent; and
- about 0% to about 8%, preferably about 3 to about 5%, of polymer particles.

All percentages are weight percentages, based on the total weight of the composition.

The compositions of the invention are preferably used in the form of aqueous emulsions. These emulsions can be prepared as follows: the fatty material(s) and polyolefin(s) or polyorganosiloxane(s) are emulsified in water using one or more dispersants and shear forces, for example, by means of a colloid mill. Suitable dispersants are known to the person skilled in the art, for example, ethoxylated alcohols or polyvinyl alcohol may be used. The dispersants may be used in customary amounts known to the person skilled in the art and may be added either to the polysiloxane or to the water prior to emulsification. Where appropriate, the emulsification operation can, or in some cases, must be carried out at elevated temperature.

The compositions and methods of the invention may be used to treat a wide range of textile materials, from hydrophobic materials to hydrophilic materials to blends thereof. Suitable examples include silk, wool, polyester, polyamide, polyurethanes, and cellulosic fiber materials of all types. Such cellulose fiber materials are, for example, natural cellulose fibers, such as cotton, linen, jute and hemp, and regenerated cellulose. The compositions of the invention are also suitable for hydroxyl-containing fibers that are present in mixed fabrics, for example mixtures of cotton with polyester fibers or polyamide fibers.

The compositions of the invention may also contain additives that are customary for standard commercial fabric softeners, for example alcohols, such as ethanol, n-propanol, i-propanol, polyhydric alcohols, for example glycerol and propylene glycol; amphoteric and nonionic surfactants, for example carboxyl derivatives of imidazole, oxethylated fatty alcohols, hydrogenated and ethoxylated castor oil, alkyl polyglycosides, for example decyl polyglucose and dodecylpolyglucose, fatty alcohols, fatty acid esters, fatty acids, ethoxylated fatty acid glycerides or fatty acid partial glycerides; also inorganic or organic salts, for example water-soluble potassium, sodium or magnesium salts, non-aqueous solvents, pH buffers, perfumes, dyes, hydrotropic agents, antifoams, antiredeposition agents, polymeric or other thickeners, enzymes, optical brighteners, antishrink agents, stain removers, germicides, fungicides, antioxidants, corrosion inhibitors and anticrease agents.

In some embodiments, the composition additionally comprises a detergent. Detergents typically contain a surfactant. In addition, a detergent can contain one or more additional components such as enzymes, bleaches, fabric softeners, perfumes, antibacterial agents, antistatic agents, brighteners, dye fixatives, dye abrasion inhibitors, anti-crocking agents, wrinkle reduction agents, wrinkle resistance agents, soil release polymers, sunscreen agents, anti-fade agents, builders, sudsing agents, composition malodor control agents, composition coloring agents, pH buffers, waterproofing agents, soil repellency agents and mixtures thereof. In some embodiments, the detergent is an oxylated detergent.

The term "surfactant," as used herein, refers to materials that are surface-active in the water. Illustrative surfactants include nonionic, cationic and silicone surfactants as used in conventional aqueous detergent systems. See, for example, U.S. Pat. No. 6,855,173, which is incorporated herein by reference.

Oxylated detergents are well known to those skilled in the art. In some embodiments, these detergents comprise one or more residues of a compound of the formula $(R'O)_zM$ where R' is an alkyl or acyl group and M is H or a metal cation of charge z. When M is H, z is preferably 1.

EXAMPLES

Example 1

The compositions listed in Table 1 below were prepared by adding glycerol monooleate (KEMESTER® 2000 from Crompton Corporation)(fatty material) and a 33% aqueous solution of an organomodified polydimethyl siloxane (having greater than 5% non-terminal hydroxyl groups) solution (REACTOSIL® RWS from Bayer Corporation) to water in 4 ounce jar and shaking the jar vigorously for about one minute.

The stability of the emulsion formed is judged visually by observing without the aid of instrumentation whether there is any visual separation of the mixture into layers upon standing one to seven days at ambient temperature of about 20° C. to about 40° C. A stable emulsion is generally a uniformly white, smooth liquid.

The testing for wicking and softness properties imparted by the compositions were determined by adding about 30 ml of the composition to the final rinse water of an automatic washing machine containing a mix of clothing of 100% polyester, 85/15 polyester/cotton, 50/50 polyester/cotton and 100% cotton fabrics. After spinning in the washing machine and tumble-drying in an electric dryer, the fabrics were tested for horizontal wickability by observing the time for absorption of a droplet of water placed onto the dry fabric. Softness was determined subjectively on the 100% cotton garment since it was the most critical to the typical consumer. The test results are shown in Table 1.

TABLE 1

| | | Active Ingredients | | | | |
|---|---|---|---|---|---|---|
| | % Active Ingredients [% (a) + (b) | Fatty Material Component (a) | Siloxane Component (b) | Testing | | |
| ID | in composition] | [% of (a) in (a) + (b)] | [% of (b) in (a) + (b)] | Emulsion Stability | Wicking | Softness |
| 1 (comparative) | 50 | 70 | 30 | Not stable | — | — |
| 2 (comparative) | 45 | 70 | 30 | Not stable | — | — |
| 3 | 48 | 65 | 35 | Stable | Excellent | Excellent* |
| 4 | 24 | 65 | 35 | Stable | Excellent | Excellent |
| 5 | 55 | 60 | 40 | Stable | Excellent | Very good |
| 6 | 46 | 60 | 40 | Stable | Excellent | Very good |
| 7 | 40 | 60 | 40 | Stable | Excellent | Very good |
| 8 | 50 | 50 | 50 | Stable | Excellent | Good |

*Fabrics treated with compositions 3-8 exhibited a dry softness rather than the slick softness found in fabrics treated with DOWNY ® fabric softener.

As can be seen from Table 1, the % active ingredient does not appear to affect the stability of the composition. However, the composition must contain at least 35% by weight of the siloxane component, based on the total weight of the active ingredients to form stable compositions. All of the compositions of the invention (ID 3-8) were stable and exhibited excellent wicking properties. All of the compositions of the invention (ID 3-8) exhibited at least good softness. The softness characteristics improved from good to very good to excellent as the level of fatty component increased from 50% to 60% to 65%, based on the total weight of the active ingredients.

Example 2

Three hundred grams of a 33% aqueous solution of an organomodified polydimethyl siloxane (having greater than 5% non-terminal hydroxyl groups) solution (REACTOSIL® RWS from Bayer Corporation) were added to 150 g of glycerol monooleate (KEMESTER® 2000 from Crompton Corporation)(fatty material) in a one-liter jar to yield a 40/60 weight ratio of glycerol monooleate to siloxane. This mixture was vigorously shaken for about one minute to form a smooth viscous emulsion. Four grams of fragrance (Rain Fresh type #4855-AAE WS from Horizon Aromatics) was added to 171 g of water to form a milky liquid after mixing. This milky liquid was added to the jar containing the emulsion of glycerol monooleate and siloxane and vigorously shaken for about one minute. This stable emulsion contained 40% active ingredients.

One hundred milliliter samples were given to four different people for evaluation. All of the testers were pleased with the wicking and softness imparted by the fabric softener; several commented on the improved drying of their cotton towels, i.e. quickness of removing water from the body.

Example 3

Example 2 was repeated, except that final emulsion of glycerol monooleate and siloxane contained 45% active ingredients. Several batches of this composition were prepared and 100 ml samples were given to 10 different people for testing in their home. All of the testers were pleased with the wicking and softness imparted by the softener; several commented on the improved drying power of their cotton towels, i.e. quickness of removing water from the body.

Example 4

To an Osterizer blender jar, 300 g of water was mixed with 100 g of an organomodified polydimethyl siloxane (having greater than 5% non-terminal hydroxyl groups) (MAGNASOFT HWS from Crompton Corporation). After blending for about one minute, a somewhat viscous slightly cloudy 33% aqueous solution was obtained. One hundred fifty grams of glycerol monooleate (KEMESTER® 2000 from Crompton Corporation)(fatty material) were added and blended for about two minutes. A smooth, stable emulsion was formed containing 40% by weight siloxane and 60% by weight glycerol monooleate with 45% active ingredients.

About 30 ml of the emulsion containing the glycerol monooleate and siloxane were added to the rinse water cycle of an automatic washing machine containing a 100% polyester CoolMax® T-shirt, three 85%/15% polyester/cotton (Drirelease®) T-shirts and one 100% cotton T-shirt. After spinning in the washing machine and tumble drying in an automatic electric dryer all the shirts wicked a drop of water instantly and felt soft.

Example 5

In a 4-ounce glass jar, 30 g of an organomodified polydimethyl siloxane (having greater than 5% non-terminal hydroxyl groups) solution (REACTOSIL® RWS from Bayer Corporation) were mixed with 15 g of a liquid containing 90% methyl bis (tallow amidoethyl) 2-hydroxyethyl ammonium methylsulfate (fatty material) and 10% isopropanol (VARISOFF 222 LM 90, quaternary ammonium compound, from Crompton Corporation). On shaking, a very viscous stable emulsion resulted with a ratio of 42.5% siloxane to 57.5% fatty material and 52% active ingredients. Forty-nine grams of water was added to the very viscous emulsion and the mixture was shaken to form a very fluid stable emulsion with 25% active ingredients.

About 40 ml of the emulsion containing fatty material and siloxane was added to the rinse water cycle of an automatic washing machine containing three 85%/15% polyester/cotton (DRI-RELEASE®) T-shirt, one 100% cotton T-shirt and one 100% polyester (COOLMAX®) T-shirt. After spinning in the washing machine and tumble-drying in an automatic electric dryer, all of the shirts wicked a drop of water instantly and felt soft with some slickness like that obtained with DOWNY® fabric softener.

Example 6

In a 4-ounce glass jar, 30 g of an organomodified polydimethyl siloxane (having greater than 5% non-terminal hydroxyl groups) (REACTOSIL® RWS from Bayer Corporation), 22.1 g water, and 15 g of a softener containing 90% methyl bis (tallow amidoethyl) 2-hydroxyethyl ammonium methylsulfate (fatty material) and 10% isopropanol (VARISOFT 222 LM 90 from Crompton Corporation), were mixed. On shaking, a stable emulsion of about the appropriate viscosity expected by consumers resulted having a ratio of 42.5% by weight siloxane and 57.5% fatty material with 35% active ingredients. After standing overnight, 0.34 g (0.5%) of fragrance (Rain Fresh type #4855-AAE WS from Horizon Aromatics) were added to the stable emulsion and shaken to mix it well. Addition of the fragrance had no effect on emulsion stability.

Example 7

A solution consisting of 70 g of hydrogen peroxide solution (35% $H_2O_2$), 6 g of DOW® Super Wetting agent, and 30 g of a softener containing 90% methyl bis (tallow amidoethyl) 2-hydroxyethyl ammonium methylsulfate (fatty material) and 10% isopropanol (VARISOFT 222 LM 90 from Crompton Corporation) and a 33% aqueous solution of an organomodified polydimethyl siloxane (having greater than 5% non-terminal hydroxyl groups) (REACTOSIL® RWS from Bayer Corporation) combined as in Example 6 above was prepared. The solution appeared to be stable during three days of storage.

250-300 g of T-shirt material, as described above, was washed with IEC Phosphate Reference Detergent(B) specified for use in British Standards Institute BS EN 26330:1994 for "Domestic washing and drying procedures for textile testing" (ISO 6330:1984). The solution described in the previous paragraph was added to the rinse cycle. After the washing process was completed, the fabric was dried in a dryer on high for 30 minutes. The fabric had no scent of hydrogen peroxide and had a "fresh" smell.

Example 8

The procedure of Example 7 was repeated except that 61 g of a polyethylene softener was used in place of the softener used previously. POMOLUBE™ 72R, a non-ionic modified polyethylene softener, is marketed by Piedmont Chemicals Industries, Inc. The fabric had a slight scent of hydrogen peroxide rather than the "fresh" smell achieved in Example 6.

Example 9

The procedure of Example 7 was repeated except as indicated herein. Forty nine grams of organomodified polydimethyl siloxane having greater than 5% non-terminal hydroxyl groups (REACTOSIL® RWS softener from Bayer Chemicals, Inc.) was used in place of the softener used previously. Upon washing, foam remained after the rinse cycle. One extra rinse cycle eliminated the foam. After drying, the fabric had no scent of hydrogen peroxide.

Example 10

Three pieces of fabric were washed once with IEC detergent. The first piece of fabric was treated with the softener of Example 7 [methyl bis (tallow amidoethyl) 2-hydroxyethyl ammonium methylsulfate] and organomodified polydimethyl siloxane) by washing machine application and dryer cure. The second piece of fabric was treated by padding a 5% solution of polyethylene softener (POMOLUBE™ 72R) onto the fabric followed by a 15 minutes cure in an oven at 150° C. The third piece of fabric was treated by padding a 4% solution of REACTOSIIL® RWS softener onto the fabric followed by a 15 minute cure in an oven at 150° C. The first piece of fabric was judged to be the softest. The second piece of fabric was judged to be next softest. The third piece of fabric was judged to be the least soft.

Example 11

Solution A was prepared by mixing 70 g of hydrogen peroxide solution (35% $H_2O_2$) and 6 g of DOW® Super Wetting agent. Solution B was prepared from a solution containing 90% methyl bis (tallow amidoethyl) 2-hydroxyethyl ammonium methylsulfate (fatty material) and 10% isopropanol (VARISOFT 222 LM 90 from Crompton Corporation) and a 33% aqueous solution of an organomodified polydimethyl siloxane (having greater than 5% non-terminal hydroxyl groups) (REACTOSIL® RWS from Bayer Corporation) combined as in Example 6. Table 2 presents wicking observations for fabrics treated as indicated therein. Horizontal wicking was tested by observing the spread for one water drop. Softness was tested by human touch.

The use of a softener of the invention with a hydrogen peroxide/wetting agent component provided stable solutions, fresh scent, and good wicking properties, when compared to commercially available softeners.

Example 12

LEE, 85/15 polyester/cotton (DR) XL white T-Shirts used for these tests. Five T-shirts were washed with IEC detergent to clean the fabric surface.

Solution C was prepared by 70 g hydrogen peroxide, 6 g DOW® Super Wetting Agent, and 30 g of a softener containing 90% methyl bis (tallow amidoethyl) 2-hydroxyethyl ammonium methylsulfate (fatty material) and 10% isopropanol (VARISOFT 222 LM 90 from Crompton Corporation) and a 33% aqueous solution of an organomodified polydimethyl siloxane (having greater than 5% non-terminal hydroxyl groups) (REACTOSWIL® RWS from Bayer Corporation) combined as in Example 6. Solution D was prepared from a softener, containing 90% methyl bis (tallow amidoethyl) 2-hydroxyethyl ammonium methylsulfate (fatty material) and 10% isopropanol (VARISOFT 222 LM 90 from Crompton Corporation) and a 33% aqueous solution of an organomodified polydimethyl siloxane (having greater than 5% non-terminal hydroxyl groups) (REACTOSIL® RWS from Bayer Corporation) combined as in Example 6.

A control shirt was tested without application of any additive. Horizontal wicking was hesitant (1 second) with small spread for one water drop. Shirts 1 to 5 were washed with TIDE® Quick Dissolving with WEARCARE® detergent,

TABLE 2

| Solution A | Softener | Horizontal Wicking Observations | Softness Observations (1 = softest, 7 = least soft) |
|---|---|---|---|
| Yes | 30 g Solution B | Instantaneous, good spread, size of a quarter | 2 |
| Yes | 61 g POMOLUBE ™ 72R | Instantaneous, good spread, size of a quarter | 6 |
| Yes | 49 g REACTOSIL ® RWS | 0.5 second spread, size of a nickel | 5 |
| No | 30 g Solution B | Instantaneous, good spread, size of a quarter | 1 |
| No | 61 g POMOLUBE ™ 72R | Instantaneous, good spread, size of a quarter | 3 |
| No | 49 g REACTOSIL ® RWS | Instantaneous, good spread, size of a quarter | 4 |
| No | None | Slow dime-sized spread | 7 |

free of dyes and perfumes. Each shirt was dried in a dryer on high for 30 minutes. Tests where Solution C or D was added during the wash or rinse cycle are presented in Table 3 below.

TABLE 3

| Shirt | Additive | Timing of Addition of Additive | Horizontal Wicking Observations | Softness Observations (1 = softest, 5 = least soft) |
|---|---|---|---|---|
| 1 | 30 g Solution D | With detergent in wash cycle | 3 seconds | 3 |
| 2 | 30 g Solution D | Rinse cycle | instantaneously, good spread | 1 |
| 3 | None | N/A | instantaneously | 5 |
| 4 | Solution C | With detergent in wash cycle | instantaneous | 4 |
| 5 | Solution C | Rinse cycle | instantaneously | 2 |

It was noted that that shirt 5 had nearly as good softness as shirt 2. Additionally, shirt 3 had equivalent softness to the control.

Example 13

Solution E was prepared by 70 g hydrogen peroxide, 6 g DOW Super Wetting Agent, 30 g of a softener containing 90% methyl bis (tallow amidoethyl) 2-hydroxyethyl ammonium methylsulfate (fatty material) and 10% isopropanol (VARI-SOFT 222 LM 90 from Crompton Corporation) and a 33% aqueous solution of an organomodified polydimethyl siloxane (having greater than 5% non-terminal hydroxyl groups) (REACTOSIL® RWS from Bayer Corporation) combined as in Example 6, and 4.2 g of Daikin D-2 PTFE (60.2% dispersion in water). Solution E did not show a large amount of foaming upon shaking. The solution appeared to be stable when allowed to stand for 30 minutes.

A LEE brand, 85/15 polyester/cotton (DR) XL white T-Shirt was used in this example. The T-shirt was washed with IEC detergent to clean the fabric surface. The T-shirt was then washed with TIDE® detergent (as described in Example 12). Solution E was added during the rinse cycle. After washing, the T-shirt was dried in a dryer on high for 30 minutes. The T-shirt was observed to have about the same wicking and softness properties as T-shirt 5 from Example 12.

Example 14

LJ Knits Style 4535 (white, single jersey, vortex spun) fabric was used in this example. Solutions A and B from Example 11 were prepared. The following treatments were prepared by mixing Solution A with the softener indicated in the table below.

| Fabric Treatment | Solution A | Softener |
|---|---|---|
| 14a | Yes | 30 g Solution B |
| 14b | Yes | 61 g POMOLUBE ™ 72R |
| 14c | Yes | 49 g REACTOSIL ® RWS |

Fabrics were wet out thoroughly by dipping in water and padding: 14a—151% water, 14b—143% water, and 14c—163% water. Fabrics were dipped in treatments and padded. Fabrics were cured as follows 14a—dry in dryer, 14b—140° C. until dry, and 14c—140° C. until dry. A control fabric along with one of each treated fabric were then washed with IEC detergent and dried in dryer to remove excess hydrogen peroxide.

Initial wicking was observed after washing with IEC detergent. The results were as follows:

| | |
|---|---|
| Control | 5 seconds |
| 14a | instantaneous |
| 14b | 3 seconds |
| 14c | none |

The samples were cut in half, one half was washed in TIDE® detergent and dried in dryer. The following wicking results were observed:

| | |
|---|---|
| Control | instantaneous |
| 14a | instantaneous |
| 14b | instantaneous |
| 14c | 4 seconds |

Moisture Management and Drying Time Tests were run with the 8 fabrics tested for wicking. All fabrics dried within 15 minutes of each other. The average drying time was 2 hours. The fabrics held from 98% to 105% moisture at spin dry weight, with control samples holding most water (by marginal amounts). The difference in drying curves was by type of detergent washed with. All fabrics performed well in the 0-20% moisture range with all drying rates maintaining over a 0.8%/minute by 10% moisture in fabric. None of the treatments harmed the fabrics moisture performance properties.

Softness was determined by touch. Their rank was as follows (1 being softest and 8 being least soft):

1. 14c, washed with IEC
2. 14a, washed with IEC
3. 14c, washed with IEC & TIDE® detergent
4. 14b, washed with IEC
5. Control, washed with IEC & TIDE® detergent
6. Control, washed with IEC
7. 14b, washed with IEC & TIDE® detergent
8. 14a, washed with IEC & TIDE® detergent The fabrics were tested for their propensity to grow mold. A perspiration (acid) solution was prepared as per AATCC test method #15. This solution was padded on a 6"×6" sample at approximately 110% weight of sample. The samples were sealed individually in zip lock bags. The bags were stored for 11 days. At this point, it was found that green mold had begun to grow—the samples are still wet. The samples had no noticeable odor but were ranked in order from the one with the least amount of mold to the one with the most amount of green mold. The rankings from best to worse were:

1. 14b washed with TIDE® detergent
2. 14a washed with IEC
3. 14b washed with IEC
4. 14c washed with IEC
5. Control washed with TIDE® detergent
6. 14a washed with TIDE® detergent
7. 14c washed with TIDE® detergent
8. Control washed with IEC Example 15

The following solutions were prepared for fabric treatment.

| Fabric Treatment | Solution A | Softener | Additional Additive |
|---|---|---|---|
| 15a | Yes | Solution B | None |
| 15b | No | Solution B | None |
| 15c | No | None | None |
| 15d (*) | Yes | | Solution D |
| 15e | Yes | 49 g REACTOSIL ® RWS | None |
| 15g | No | 49 g REACTOSIL ® RWS | None |
| 15h | No | 61 g POMOLUBE ™ 72R | None |
| 15i (*) | Yes | None | None |

All samples were fabric 4535 (described in Example 14 above). The samples were treated in the washing machine, except for two samples with *'s, which were treated by padding.

A 1% solution of isovaleric acid was padded onto each sample. Isovaleric acid is the major contributor to body odor and is used to simulate that odor. The sample was then placed in a sealed zip lock bag for one hour. The smell was then ranked on a scale of 0-5 with 0 being a fresh smell and 5 being the worst. The samples were placed in zip lock bag for 1 hour (unzipped) and re-rated. The samples were taken out of the bags and left in open air (under a hood) overnight for a total of 18 hours. The smell was ranked again. The samples were then washed and dried with Tide detergent twice. The smell was ranked after each wash and dry cycle. The results were as follows.

| | Total Time | | | | |
|---|---|---|---|---|---|
| | 1 hour (zipped) | 2 hours (unzipped) | 20 hours (open air) | 1 wash | 2 washes |
| Sample #15a | 5 | 5 | 1 | 1 | 0.5 |
| Sample #15b | 5 | 5 | 2 | 1 | 1 |
| Sample #15c | 5 | 5 | 2 | 2 | 2 |
| Sample #15d | 3 | 2 | 0.5 | 0 | 0 |
| Sample #15e | 4 | 3 | 1 | 1 | 0.5 |
| Sample #15f | 5 | 5 | 1.5 | 1 | 1 |
| Sample #15g | 5 | 5 | 2 | 2 | 1 |
| Sample #15h | 5 | 5 | 2 | 2 | 1 |
| Sample #15i | 3 | 2 | 0.5 | 0 | 0 |

0 = no smell;
5 = overpowering smell

Overall, the Control fabric (#15c) had the worst smell ratings. Sample #15d along with sample #15i had the best smell ratings.

Example 16

An assortment of fabrics and garments with horizontal wicking from instantaneous to non-wetting (>60 sec. without visible wicking) were separated into two equal groups. Both groups were washed in a Miele Novotronic W1918 washer at 140° F. with British Standards IEC detergent for 5 minutes on the Rapid Wash cycle, dried at 90° C. for 15 minutes and checked again for horizontal wicking times. One group was then treated in the same way as above with the equivalent of 0.2% on dry weight of Daikin D-2 PTFE nanoparticle dispersion. Solutions A ($H_2O_2$+Dow wetting agent) and B, as described in Example 11, were mixed to make Solution E of Example 13, and then mixed with 50 grams of Cheer Colorguard detergent to make 1) a combined detergent/softener/oxidant/high performance treatment for athletic wear. The Solution B alone was then mixed with WIN Sport Performance detergent with Super Oxidant to make 2) an equivalent mixture. These detergent/softener/oxidant/drying rate accelerant mixtures were then applied by adding 145 g of each in the 8.4 liter of water in the Rapid Wash, 6 minute, 140° F., small load wash cycle of the Miele home washer above. The fabric used in samples B-1 and B-3 was the same Lee brand tee shirt used in Examples 12 and 13 for wicking and softness comparisons. The samples 16-1 and 16-3 were the same LJ 4535 circular knit, white jersey, 4.8 oz/yd$^2$ used in Examples 14 for wicking, softness, drying rate and mold growth, and in 15 for odor control. The fabric sample size was designed so that they would be exposed to softener and $H_2O_2$ in the wash each at 2% concentrations, and to PTFE solids equal to 0.2% of their dry weights. The washed and thus treated fabric samples were then dried as above and compared to samples 14a which had been treated with Solutions A plus B by padding, and with samples 15a(A+B), b (B only) and c(untreated control), where the additives were applied by washing machine, but without detergent.

All samples are tested in horizontal wicking, softness, smell and drying rates versus the controls. All of the treated samples wicked more quickly than their initial 2 to 60+ seconds times as untreated controls. All softener-treated samples were judged significantly softer and those with oxidants are expected to have less mold growth and odor after one day exposure to underarm male body odor than the untreated controls, based on previous testing. The drying rates are expected to be equal to or better than the same treatments applied without detergent on the 4535 fabric of Examples 14, where they were applied by padding, and 15, where they were applied by washing.

When ranges are used herein for physical properties, such as molecular weight, or chemical properties, such as chemical formulae, all combinations, and subcombinations of ranges and specific embodiments therein are intended to be included.

The disclosures of each patent, patent application and publication cited or described in this document are hereby incorporated herein by reference, in their entirety.

Those skilled in the art will appreciate that numerous changes and modifications can be made to the preferred embodiments of the invention and that such changes and modifications can be made without departing from the spirit of the invention. It is, therefore, intended that the appended claims cover all such equivalent variations as fall within the true spirit and scope of the invention.

What is claimed is:

1. A composition, comprising:

a. at least one fatty material, wherein said fatty material is a fatty acid quaternary ammonium compound having amide functionality;

b. at least one water-soluble polyorganosiloxane having substituents; and c. at least one bleaching agent;

wherein said polyorganosiloxane is present at a level of at least about 35% by weight, based on the total weight of said fatty material, said polyorganosiloxane, said polyolefin, and said bleaching agent; and wherein said substituents comprise at least about 5% by weight, based on the total weight of said substituents, of non-terminal hydroxyl groups.

2. The composition of claim 1, wherein said bleaching agent is hydrogen peroxide, inorganic peroxohydrate, organic peroxohydrate, or organic peroxyacid.

3. The composition of claim 2, wherein said bleaching agent is hydrogen peroxide.

4. The composition of claim 1, wherein said polyorganosiloxane has a melting point less than about 38° C.

5. The composition of claim 1, wherein said polyorganosiloxane does not contain nitrogen.

6. The composition of claim 1, further comprising at least one emulsifier.

7. The composition of claim 6, wherein said emulsifier is a cationic surfactant or a nonionic surfactant.

8. The composition of claim 7, wherein said emulsifier is a cationic surfactant.

9. The composition of claim 1 further comprising at least one detergent.

10. A method of treating a textile, comprising the step of:

contacting said textile with a composition of claim 9.

11. An aqueous composition, comprising:

a. Water; and b. the composition of claim 1.

12. The aqueous composition of claim 11, wherein said composition is in the form of an emulsion or suspension.

13. The composition of claim 1, further comprising discrete, individual polymer particles, wherein said polymer particles are polytetrafluoroethylene.

14. The composition of claim 13, further comprising at least one wetting agent.

15. A method of treating a textile, comprising the step of:

contacting said textile with said composition of claim 13.

16. The method of claim 15, wherein said textile is made from hydrophilic fibers, hydrophobic fibers or a combination thereof.

17. The method of claim 15, wherein said composition is added to rinse water in a laundering process, or in a final scouring of a fabric finishing operation.

18. The method of claim 17, wherein said composition is added to rinse water in a laundering process.

19. A method of treating a textile, comprising the step of:

contacting said textile with said composition of claim 1.

20. The method of claim 19, wherein said textile is made from hydrophilic fibers, hydrophobic fibers or a combination thereof.

21. The method of claim 19, wherein said composition is added to rinse water in a laundering process, or in a final scouring of a fabric finishing operation.

22. The method of claim 21, wherein said composition is added to rinse water in a laundering process.

23. A composition, comprising:

a. at least one fatty material, wherein said fatty material is a fatty acid quaternary ammonium compound having amide functionality;

b. at least one water-soluble polyorganosiloxane having substituents c. discrete, individual polymer particles, wherein said polymer particles are polytetrafluoroethylene;

d. optionally, at least one bleaching agent; and e. at least one oxylated detergent;

wherein said polyorganosiloxane is present at a level of at least about 35% by weight, based on the total weight of said fatty material, said polyorganosiloxane, said polyolefin, and said bleaching agent; and wherein said substituents comprise at least about 5% by weight, based on the total weight of said substituents, of non-terminal hydroxyl groups.

24. A method of treating a textile, comprising the step of:

contacting said textile with a composition of claim 23.

* * * * *